United States Patent [19]

Musschoot

[11] Patent Number: 4,611,469

[45] Date of Patent: Sep. 16, 1986

[54] METHOD AND APPARATUS FOR COOLING FOUNDRY SAND

[75] Inventor: Albert Musschoot, Barrington, Ill.

[73] Assignee: General Kinematics, Barrington, Ill.

[21] Appl. No.: 391,987

[22] Filed: Jun. 25, 1982

Related U.S. Application Data

[60] Division of Ser. No. 198,462, Oct. 20, 1980, Pat. No. 4,348,867, which is a division of Ser. No. 63,577, Aug. 3, 1979, Pat. No. 4,252,001, which is a continuation-in-part of Ser. No. 918,515, Jun. 23, 1978, abandoned, which is a continuation-in-part of Ser. No. 780,670, Mar. 23, 1977, abandoned, which is a continuation-in-part of Ser. No. 761,414, Jan. 27, 1977, abandoned.

[51] Int. Cl.[4] ..... F25B 19/00

[52] U.S. Cl. ..... 62/100; 34/15; 34/92; 34/164; 62/268

[58] Field of Search ..... 62/100, 268, 62; 34/15, 34/92, 164

[56] References Cited

U.S. PATENT DOCUMENTS

| | | | |
|---|---|---|---|
| 2,621,492 | 12/1952 | Beardsley et al. | 34/15 |
| 2,648,206 | 8/1953 | Carr | 62/63 |
| 2,758,445 | 8/1956 | Saxe | 62/63 |
| 2,848,008 | 8/1958 | Dietert et al. | 164/453 |
| 3,099,138 | 7/1963 | Hightower et al. | 62/100 |
| 3,141,129 | 7/1964 | Dietert | 164/457 |
| 3,205,543 | 9/1965 | Morris | 62/63 |
| 3,510,374 | 5/1970 | Walker | 164/154 |
| 3,733,716 | 5/1973 | Bouteil | 34/164 |
| 3,742,614 | 7/1973 | Bettermann et al. | 34/164 |
| 3,868,213 | 2/1975 | Skulika et al. | 34/164 |
| 3,958,623 | 5/1976 | Vissers et al. | 164/5 |
| 4,264,415 | 4/1981 | Galow et al. | 34/174 |

*Primary Examiner*—Ronald C. Capossela
*Attorney, Agent, or Firm*—Wood, Dalton, Phillips Mason & Rowe

[57] ABSTRACT

The invention relates to a method for treating moist pulverulent material and is particularly useful for removing the moisture from such material. In one aspect of the invention, the material is hot foundry sand, where the sand is first moistened by the addition of water and then the moist sand is treated in a vibrating container under vacuum.

2 Claims, 2 Drawing Figures

METHOD AND APPARATUS FOR COOLING FOUNDRY SAND

CROSS REFERENCE

This is a division of application Ser. No. 198,462 filed Oct. 20, 1980 now U.S. Pat. No. 4,348,867, which application is a division of my application Ser. No. 63,577 filed Aug. 3, 1979, now U.S. Pat. No. 4,252,001, which is a continuation-in-part of my application Ser. No. 918,515 filed June 23, 1978 now abandoned, which in turn was a continuation-in-part of my earlier filed application Ser. No. 780,670 filed Mar. 23, 1977, now abandoned, which in turn was a continuation-in-part of my earlier application Ser. No. 761,414 filed Jan. 27, 1977, now abandoned.

BACKGROUND OF THE INVENTION

Sand used in foundry casting operations is a matter of some expense in the foundry process, particularly in the usual case where additives are included in the sand to make it more adaptable for the intended purpose. For this reason, it is desirable to reuse the sand in subsequent casting operations, and most desirable to prepare the sand for reuse without losing or destroying the relatively expensive additional materials which are included in the sand.

When sand is removed from the flask or mold in which the casting has been poured, it is quite hot and if merely piled on the floor and left to cool, a great deal of floor space would be required inasmuch as the middle of the pile would cool very slowly.

If sand is cooled by subjecting it to a blast or flow of cool air, cooling can be effected but a great deal of the fine additive material will be carried off in the airstream. This results in a requirement for a large bag room, i.e., an enclosure containing a large bag through which the air may pass but which tends to block passage of the fine particles. This is not only expensive, it also results in the loss of the fine additive materials from the foundry sand mix.

SUMMARY OF THE INVENTION

Foundry sand coming directly from a metal pouring operation is very hot, in fact so hot as to normally assure that no moisture is present in the sand. After the sand has been separated from the mold or flask and the casting itself, it still is quite hot and it is desirable that the sand be cooled without loss of fine additives so that it can be reused in a relatively short time. It is also preferable that a continuous method of cooling sand, preparing it for reuse, be provided. The apparatus and method of the present invention fulfill the foregoing requirements by providing an arrangement wherein the Btu content of the hot foundry sand to be cooled is measured and water is added at a specified ratio depending upon the Btu. The moistened sand is then introduced into a container which is vibrated in order to coat each particle of sand with water, the container is then evacuated to cause the moisture to evaporate with the resultant cooling effect, and subsequently the cooled sand is withdrawn from the container. Two such containers are provided together with automatic controls so that while the pressure in one container is being reduced to cause evaporation, the other container is being supplied with moistened sand. Preferably, only half of the sand in a container is removed after the evaporation process, and the container is then refilled and the vibrating and evacuation step is repeated. Thus, each particle of sand is treated twice in the container, i.e., twice subjected to vacuum and evaporation, with the interval between the first and second cycle serving to insure that heat in the interior of each grain of sand may penetrate to the exterior of the grain and thus assure complete cooling.

DESCRIPTION OF THE PREFERRED EMBODIMENT

Figure 1:
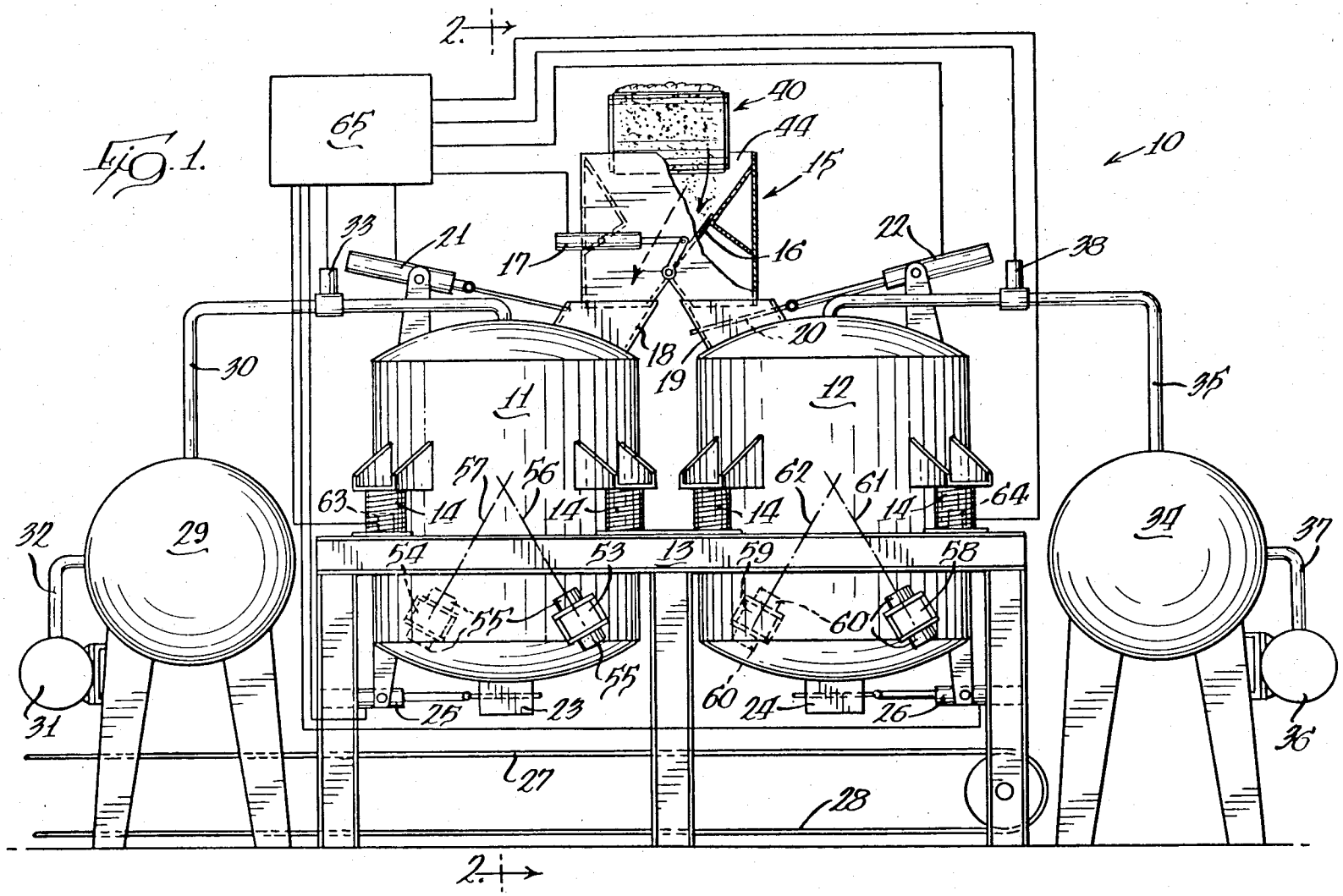
FIG. 1 is an elevational view of an apparatus capable of performing the process.

Referring now to FIG. 1 of the drawings, the sand cooling apparatus 10 includes a first treatment container 11 and a second treatment container 12. The containers are supported on a base frame 13 by isolation springs 14. Above the containers is a hopper 15 having a flap valve 16 movable by a solenoid 17 from the position shown wherein sand is directed into the container 11 to the opposite position illustrated in dotted lines wherein sand from the hopper will be directed into the container 12. The container 11 is provided with an entry chute 18 opening into the top of the container 11 and a similar chute 19 is provided for the container 12. Each of the chutes 18 and 19 is equipped with a valve such as is shown at 20, with the valves being operated by solenoids 21 and 22 and being effective when actuated to close off the containers 11 and 12 from the atmosphere.

Outlets 23 and 24 are provided at the bottoms of containers 11 and 12 and solenoids 25 and 26 control valves in each of the outlets so as to permit sand to exit from the container onto the upper surface 27 of a belt conveyor. The return flight of the conveyor is indicated at 28.

Associated with the container 11 is a vacuum chamber 29 connected to the container 11 by conduit 30. A vacuum pump 31 is connected by pipe 32 to the vacuum chamber 29 and a solenoid operated valve 33 is arranged to open and close the conduit 30, i.e., to permit or prohibit communication between the vacuum chamber 29 and the container 11.

A second vacuum chamber 34 is connected by means of conduit 35 to the second container 12. Associated with the second vacuum chamber is a vacuum pump 36 connected thereto by pipe 37 and a solenoid operated valve 38 operates in similar fashion to the valve 33.

The vacuum system is arranged to reduce the pressure in the container to cause evaporation of the water coating the grains of sand to effect the cooling. If sand at 150° F. is acceptable, the vacuum system arrangement should reduce the pressure in the container to about 5 psi absolute or slightly less. If cooler sand is desired, the pressure can be made to go as low as 3 psi absolute or even lower.

Figure 2:
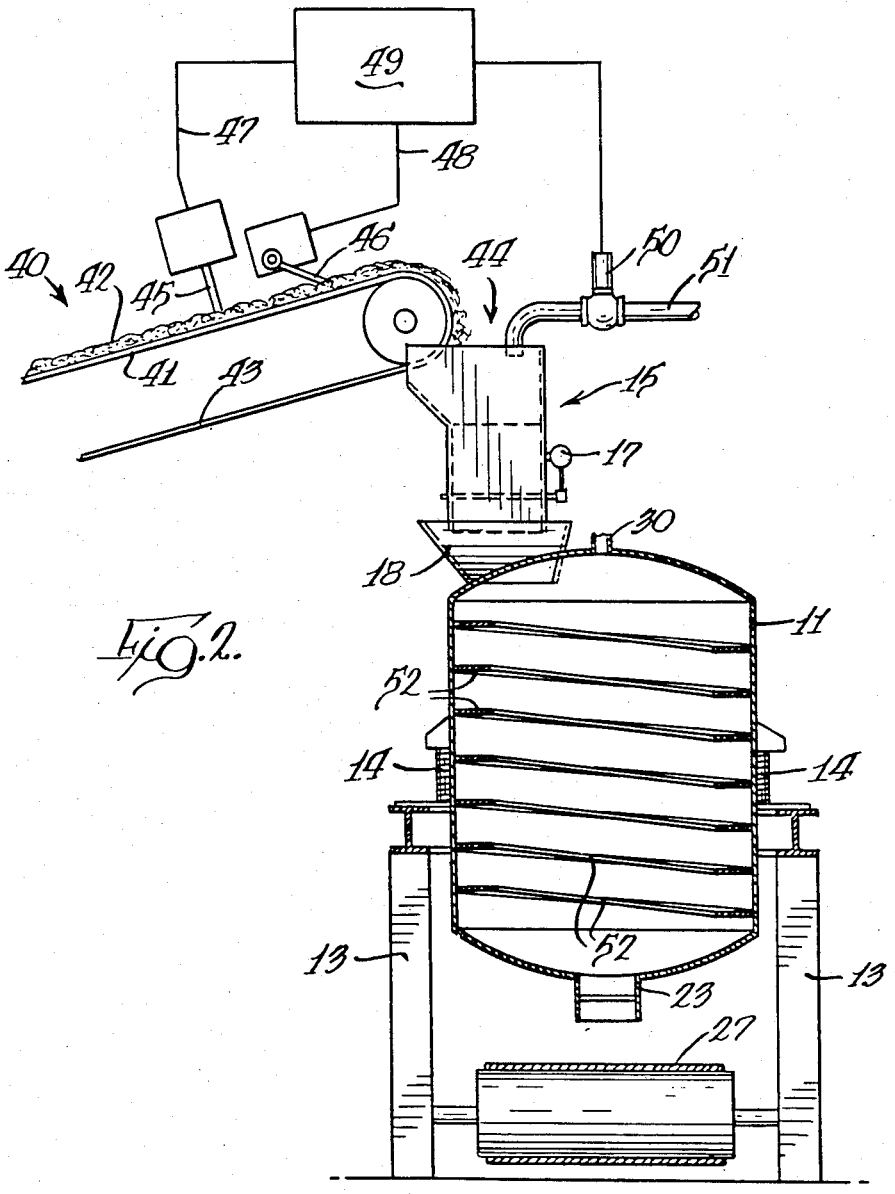
FIG. 2 is a vertical section along line 2—2 of FIG. 1.

Referring now to FIG. 2 of the drawings, there is shown a means for conveying the hot foundry sand to the apparatus previously described. Thus, a belt conveyor 40 is provided with upper flight 41 on which the hot sand 42 is conveyed toward the hopper 15. The conveyor has a return flight 43. The sand on the upper flight 41 falls into the open top 44 of the hopper 15, and is directed into either the container 11 or 12 by the operation of the flap valve 16.

Closely adjacent the hopper 15 and associated with the belt conveyor 40 is a temperature sensor 45 for sensing the temperature of the sand. A pivoted paddle arrangement 46 is also associated with the container 40 for detecting the depth of the sand on the upper flight 41. The outputs of the temperature sensor 45 and depth sensor 46 are transmitted by leads 47 and 48 respectively to a first control mechanism 49. The control mechanism 49 is arranged to operate a solenoid control valve 50 which controls the rate of flow of water through a pipe 51 into the opening 44 of the hopper 15.

The first control device 49 is arranged to control the flow of water into the hopper 15 at a rate determined by the Btu content of the sand 42. The control device 49 computes the Btu content in response to both the temperature and depth of the sand and regulates the flow of water so as to provide one pound of water for every 1100 Btu's in the sand 42.

Water and sand are introduced into the containers (container 11 shown in FIG. 2) for subsequent treatment. Each of the containers 11 and 12 is equipped with spiral flights 52 running along the interior surface thereof for purposes hereinafter to be described.

Referring again to FIG. 1, means are provided for vibrating each of the containers 11 and 12. As previously pointed out, the containers are supported on isolation springs 14 and thus are mounted for vibratory movement in a general vertical direction. To effect vibration of the container 11 there is mounted thereon a pair of electric motors 53 and 54 on opposite sides of the container with the motors having double-ended shafts, each end carrying eccentrics 55. The axes of the motor shafts are inclined to the vertical as indicated by lines 56 and 57.

Similar motors 58 and 59 are mounted on opposite sides of the container 12 with the motors 58 and 59 carrying double-ended shafts on the ends of which are mounted eccentric weights 60. Like the motors on container 11, the axes of the motor shafts on container 12 are inclined to the vertical as indicated by lines 61 and 62.

Load sensors 63 and 64 are mounted on the interior of two of the isolation springs 14, one load sensor being associated with the container 11 and the second with the container 12, with the load sensor being operable to determine the load of sand and water in each of the containers, again for a purpose to be hereinafter described.

A second control device 65 is connected by the leads shown to the load sensors 63 and 64, the outlet valve solenoids 25 and 26 to the top closing valve solenoids 21 and 22, and to the solenoid valves 33 and 38 effecting communication between the vacuum chambers and the containers.

In carrying out the method of the present invention with the apparatus described, the sand and water mixture is introduced into the top 44 of hopper 15 and directed by the flap valve into the container 11. On start-up, the container is filled with the water/sand mixture and the fact of its being filled will be sensed by the load sensor 63 and the control mechanism 65 so as to move the flap valve to a position directing sand and water into the container 12. The control mechanism 65 will then operate the solenoid 21 and close off the top of the container 11 and subsequently to open the solenoid valve 33 to place the interior of the container 11 into communication with the vacuum chamber 29. With the motors 53 and 54 operating, the container 11 will be vibrated vertically in a generally spiral direction, i.e., not directly up and down but with a slight rotation. The vibrational path followed by the container 11 will closely parallel the inclination of the flights 52 with the net result that the water and sand are thoroughly mixed to insure the coating of each grain of sand with a film of water. Vibration of the container is continuous throughout the process.

After initial start-up, and assuming both containers 11 and 12 to be filled with the sand and water mixture, control device 65 actuates solenoid 25 to open the outlet 23 from the container 11 and at the same time operates solenoid 21 to open the top of that container. Solenoid 17 is also operated to move the flap valve to the position shown to direct the sand/water mix into the container 11. In the preferred arrangement, after about one minute approximately one-half of the sand in the container 11 has exited through the outlet 23 and an equal amount has entered through the chute 18. While this is occurring, container 12 is sealed off from the atmosphere and placed into communication with the vacuum chamber 34 by operation of the solenoid valve 38. Preferably, the rate of discharge from the outlet 23 is slightly greater than the rate at which fresh sand/water mixture is introduced into the container. After one minute, control 65 closes the outlet 23 by actuating the solenoid 25. The sand/water mix will continue to flow into the container until the load sensor 63 senses that the container is filled at which time a signal will be delivered to the control 65 which, through actuation of solenoid 21, will operate the valve closing off the top of the container from communication with the atmosphere and actuate the flap valve so as to deliver sand and water mixture to the container 12. The latter container, shortly before the actuation of the flap valve, has been closed off from the vacuum chamber 34 by actuation of the solenoid valve 38 and the solenoid 26 is actuated to open the outlet and discharge the cooled sand. The solenoid 22 is also actuated to open the top of the container 12 so that the sand/water mix may flow therein. In the meantime, with closing off the container 11 by closing of the outlet and inlet, solenoid valve 33 is actuated to place that container in communication with the vacuum chamber 29.

From the foregoing it can be seen that the cooling process is a continuous one with each grain of sand being subjected twice to vacuum treatment. Cooled sand is exiting from one container while fresh hot sand is being introduced, with the timing cycle being such that about one minute (which is the time I prefer) is required to empty half of the contents of the container and to add an equal amount. While one container is being partially (i.e. one-half) emptied of twice-treated sand and refilled with fresh sand for treatment, the other container is subjected to vacuum to effect the cooling.

Even though the containers are vibrated, there will still exist a division between the half of the sand that remained in the container during the emptying operation, and the newly added sand to refill the container. In other words, the sand at the bottom of the container will be that which was introduced in the preceding cycle, not the current cycle, thus assuring the double treatment of each particle.

Thus it can be seen from the foregoing that there is provided a method and apparatus which cools foundry sand by evaporation. Each grain of sand is thoroughly coated with a film of water and then subjected to two vacuum treatments causing the moisture coating the sand to evaporate with the attendant cooling effect, simultaneously permitting the interior heat of each grain of sand to pass to the exterior surface for dissipation with the evaporation. While one container is being emptied of half its load, the other container is being subjected to vacuum, and thus a continuous supply of sand may be treated by being directed into either one container or the other, with the filling operation in one container being carried on while the vacuum treatment is occurring in the other container.

I claim:

1. The method for treating moist pulverulent material which comprises introducing the moist material into a container, applying a vacuum of less than 5 psi absolute to the container to evaporate the water from the material, vibrating the container while the vacuum is being applied thereto, returning the pressure in the container to atmospheric, removing material from the container, refilling the container with moistened material and again applying a vacuum to the container to reduce the pressure therein to less than 5 psi absolute.

2. The method for treating moist pulverulent material which comprises introducing the moist material into a container, applying a vacuum of less than 5 psi absolute to the container to evaporate the water from the material, vibrating the container vertically while the vacuum is being applied thereto, returning the pressure in the container to atmospheric, removing approximately one-half of the material from the bottom of the container, refilling the container from the top with moist material and again applying a vacuum to the container to reduce the pressure therein to less than 5 psi absolute to evaporate further water from the material, again vibrating the container vertically while the vacuum is being applied thereto, again returning the container to atmospheric pressure and then removing approximately one-half of the material from the bottom of the container.

* * * * *